United States Patent [19]

Labrot et al.

[11] Patent Number: 4,958,767

[45] Date of Patent: Sep. 25, 1990

[54] PROCESS AND DEVICE FOR INJECTING A MATTER IN FLUID FORM INTO A HOT GASEOUS FLOW AND APPARATUS CARRYING OUT THIS PROCESS

[75] Inventors: Maxime Labrot; Jean Feuillerat, both of Bordeaux; Yves Valvy, Issac, all of France

[73] Assignee: Aerospatiale Societe Nationale Industrielle, Paris, France

[21] Appl. No.: 188,425

[22] Filed: Apr. 29, 1988

[30] Foreign Application Priority Data

Apr. 29, 1987 [FR] France ..... 87 06084

[51] Int. Cl.[5] ..... B05B 1/24; B05B 17/04

[52] U.S. Cl. ..... 239/13; 219/121.48; 219/121.51; 239/79; 239/85; 239/424

[58] Field of Search ..... 239/13, 79, 81, 82, 239/85, 424; 219/121.47, 121.48, 121.51, 76.16

[56] References Cited

U.S. PATENT DOCUMENTS

| | | | |
|---|---|---|---|
| 2,992,869 | 1/1960 | Giannini et al. | 219/129.47 |
| 3,062,451 | 11/1962 | Keohane, Jr. | 239/79 |
| 3,894,209 | 7/1975 | Fairbairn | 219/129.47 |
| 4,065,057 | 12/1977 | Durmann | 239/79 |
| 4,416,421 | 11/1983 | Browning | 239/79 |
| 4,540,121 | 9/1985 | Browning | 239/79 |
| 4,616,779 | 10/1986 | Serrano et al. . | |

FOREIGN PATENT DOCUMENTS

| | | | |
|---|---|---|---|
| 163776 | 12/1985 | European Pat. Off. | 239/85 |
| 2001694 | 9/1969 | France . | |
| 1199283 | 12/1985 | U.S.S.R. | 239/79 |
| 432831 | 8/1935 | United Kingdom | 239/85 |

*Primary Examiner*—Andres Kashnikow
*Assistant Examiner*—Michael J. Forman
*Attorney, Agent, or Firm*—Fisher, Christen & Sabol

[57] ABSTRACT

This invention relates to a process and device for injecting at least one stream of a fluid matter into a hot gaseous flow, such as a plasma jet. According to the invention, said hot gaseous flow has the shape of an envelope of revolution communicated thereto, and the nozzle for injection of the stream of fluid matter is dispsoed coaxially to the axis (X—X) of said envelope of revolution. The invention is more particularly applicable to plasma chemistry.

13 Claims, 4 Drawing Sheets

3
14
F9
F9
13
15
19
F4
12
F11
F11
14
1
F2
F2

3
12
14
13
F9
F7
F9
15
19
F4
24
23
F11
F2
F2
1

PROCESS AND DEVICE FOR INJECTING A MATTER IN FLUID FORM INTO A HOT GASEOUS FLOW AND APPARATUS CARRYING OUT THIS PROCESS

The present invention relates to a process and a device for injecting at least one stream of a matter in fluid form into a hot gaseous flow, such as a plasma jet. It also relates to an apparatus for carrying out this process and for effecting all sorts of operations and reactions by means of a hot gaseous flow.

It is known that, in recent years, techniques have been developed, of chemical reactions and of various operations (fusion, recrystallization, pyrolysis, etc.), sometimes called plasma chemistry, employing a gas or finely divided matters, such as powders and liquids possibly propelled by a gas, and a plasma jet. In accordance with these techniques, such matters, generally called reagents, are injected into the hot flow constituted by the plasma jet.

It is particularly important, for the quality of the results obtained, that the injection of the reagents allows a homogeneous distribution and a perfect dissolution thereof in said flow. Now, a plasma jet is known to present a high viscosity, with the result that the injection of the reagents is a delicate problem to solve, since the particles of these reagents bounce on the plasma jet. This is particularly the case when it is a question of causing droplets of liquid or particles (of which the size varies from some microns to 1000 microns) to penetrate into a plasma jet of which the temperature and pressure are respectively of the order of 2000° C. to 10,000° C. and from 1 to 20 bar.

Different methods have already been proposed for injecting reagents into a plasma jet. These methods generally employ the injection of the reagents either upstream or at the level of the plasma generator, or downstream thereof.

In the first case, a certain number of difficulties are avoided, particularly that of the mixture of the cold reagents and of the hot plasma jet due to the considerable viscosity of the latter. On the other hand, since the reagents must pass through the plasma generator, this method cannot be carried out with reagents which risk reacting either with the electrodes or with the walls of the generator. Moreover, it can be used only with plasma generators of which the structure lends itself to such an injection.

In the case of injection downstream of the generator, one operates in different ways. A fluidized bed may be made, in which particles of reagents are in suspension in annexed reservoirs and these particles may be entrained towards the hot flow. In that case, the difficulties set forth hereinabove are encountered, due to the viscosity of the hot flow. The particles may also be made to drop into the hot flow by gravity. However, there again, the reagent mixes little with the hot flow, a considerable part of the particles of the reagents tending to bounce thereon.

In order to improve the yield of such an injection downstream of the plasma generator and to allow a good homogeneity and satisfactory dissolution of the reagents in a hot gaseous flow, U.S. Pat. No. 4,616,779 discloses a process for injecting at least one stream of a finely divided matter into a hot gaseous flow, such as a plasma jet, whereby there is interposed on the path of said hot gaseous flow a screen pierced with a plurality of orifices spatially distributed about the axis of said hot gaseous flow, so as to divide the latter into a plurality of elementary flows presenting at least substantially the same general direction, and said stream of finely divided matter is conducted to at least one nozzle at least partially surounded by said orifices, in order to create at least one stream of finely divided matter, of direction at least substantially similar to that of said elementary hot gaseous flows and surrounded by at least certain of them.

An at least substantially coaxial injection is thus produced of the current of finely divided matter into the hot gaseous flow, with the result that the conditions of transfer between the hot jet and the reagent, as well as the homogeneization of the mixture, are promoted, whilst allowing entrainment, and therefore the reaction, of all the particles of reagent by the hot flow.

It is an object of the present invention to improve the process of the Patent mentioned hereinabove, in order to improve the performances thereof still further.

To that end, according to the invention, the process for injecting at least one stream of a fluid matter into a hot gaseous flow, such as a plasma, whereby there is interposed on the path of said hot gaseous flow a device for shaping this hot gaseous flow and said fluid matter is conducted to at least one nozzle, creating a stream of fluid matter of which the direction is at least substantially similar to the general direction of said hot gaseous flow shaped by said device, is noteworthy in that there is communicated to said hot gaseous flow the shape of an envelope of revolution and in that said injection nozzle is disposed coaxially to the axis of said envelope of revolution.

In this way, according to the invention, said fluid matter is injected inside the hot gaseous flow and, due to the high viscosity thereof, the particles of said matter cannot escape and remain captive of the plasma, with which they are finally intimately mixed. The drawback encountered in the prior techniques, due to the viscosity of the plasma, is therefore turned to advantage.

It will be noted that, in U.S. Pat. No. 4,616,779, the elementary flows of plasma partially surround the outlet nozzle of the particles of the finely divided matter, with the result that advantage is already taken, to a certain extent, of the effect of trapping of the particles of finely divided matter by the plasma. However, in that case, free spaces exist between two peripherally consecutive elementary flows, with the result that particles may escape through these spaces and leave the plasma. According to the invention, there is no passage for the particles from inside the plasma to outside and this results in the performances of the process of U.S. Pat. No. 4,616,779 being further improved.

In a first embodiment of the present invention, said envelope of revolution of plasma is at least substantially cylindrical. In that case, the plasma and the fluid matter are intimately mixed downstream of the shaping device, at a distance equal to several, for example twenty, times the diameter of the hot gaseous flow.

In order to accelerate incorporation of the particles of fluid matter in the plasma, it is advantageous, in a second embodiment, if said envelope of revolution is at least substantially conical. In this way, said particles are imprisoned in the cone of plasma and are forced to mix therewith.

The fluid matter may leave the nozzle in the form of a stream of homogeneous circular section. However, it may be preferable if, like the hot gaseous flow, the stream of fluid matter leaving the nozzle presents an annular section.

It may also be advantageous if the hot gaseous flow in the form of an envelope of revolution and/or the stream of fluid matter are placed in turbulence immediately downstream of said shaping device. In that case, it is often preferable that it be the stream of fluid matter and, in that case, said nozzle comprises vanes, baffles, flanges or like means for creating vortices in said stream of fluid matter.

The stream of fluid matter is most often injected on the downstream side of said hot gaseous flow, i.e. directly inside said envelope. However, it may also be injected on the upstream side, with the result that the fluid matter passes through said shaping device with said hot gaseous flow, with which it begins to be mixed in said device.

It is also possible to inject the fluid matter towards upstream and towards the downstream of the hot gaseous flow. This variant is particularly advantageous when two different fluid matters are to be used.

In order easily to carry out this process, the invention provides a shaping or injection device constituted by a peripheral body and by a central body defining therebetween a channel of revolution, said central body being provided with at least one nozzle. Said central body may be maintained fast with the peripheral body by at least one arm passing through said channel of revolution and the length of said channel, downstream of said arm, is at least equal to once the diameter of the gaseous flow upstream of said device. In this way, the length of said channel is sufficient for the disturbences of flow associated with the presence of said arm in said channel to be eliminated at the outlet of said device.

It is advantageous if the or each nozzle of said central body be supplied with fluid matter by a conduit traversing such an arm.

Said device is preferably provided with a circuit for circulation of a cooling fluid and this circuit comprises conduits traversing said arm, in order to cool the central body.

The injection device according to the invention may be manufactured by non-porous foundry (with ceramic core). It may be made of copper or stainless steel, for example.

In order to avoid stresses, the annular section of the channel of revolution presents an area at least equal to that of the section of the incident hot gaseous flow.

The device according to the invention may thus be connected to a plasma torch of which the thermic power is of the order of 2.5 MW and may be used for injecting up to one ton/hour of pulverulent matter.

According to the invention, an apparatus for reaction and/or for treatment of at least one matter in fluid form in a hot gaseous flow, such as a plasma jet, comprising a generator of said hot gaseous flow and means for supplying said fluid matter, is noteworthy in that it comprises a device interposed on the path of said hot gaseous flow and constituted by a peripheral body and by a central body defining therebetween a channel of revolution, said central body being provided with at least one nozzle whose axis is coaxial to the axis of revolution of said channel.

The invention will be more readily understood on reading the following description with reference to the accompanying drawings, in which:

FIGS. 1 to 3 schematically illustrate three different embodiments of the present invention.

Figure 1:
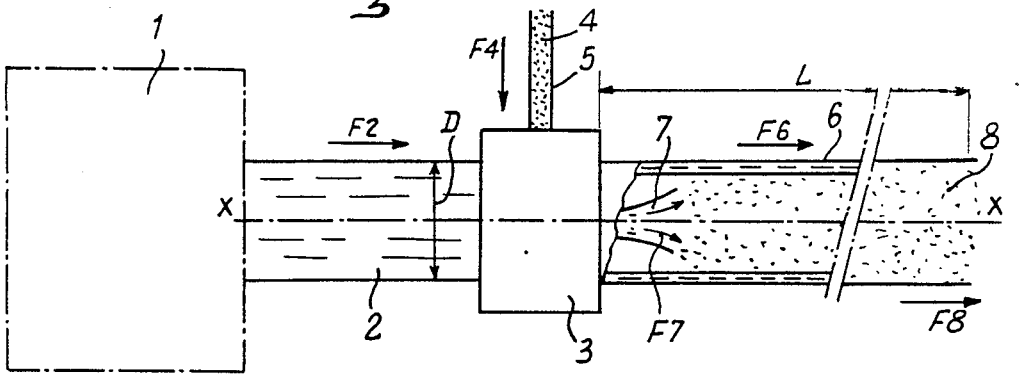
Figure 2:
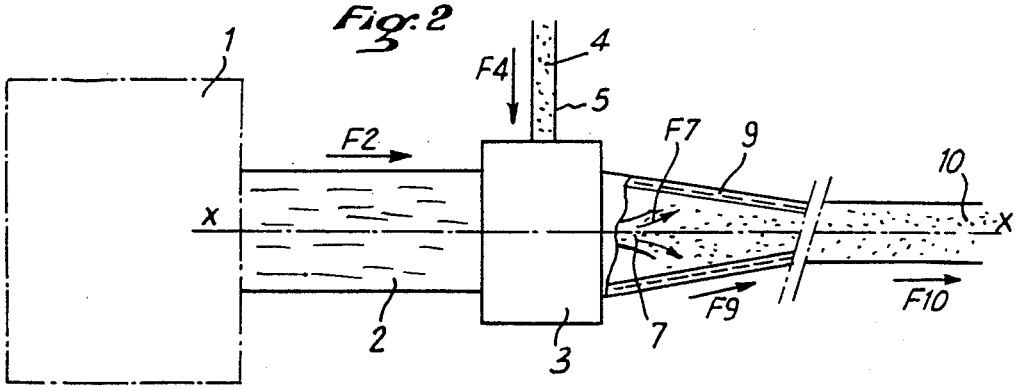
Figure 3:
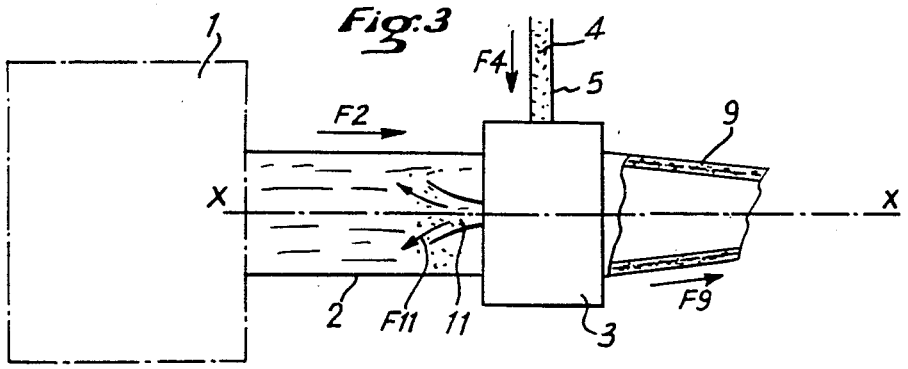

Referring now to the drawings, the device according to the invention, shown schematically in FIGS. 1 to 3, comprises a plasma generator symbolized by a rectangle 1 in chain-dotted lines and emitting a plasma jet 2 of axis X—X of uniform section. On the path of the plasma jet 2, which moves in the direction of arrow F2, there is interposed an injection device 3 supplied with a matter 4 in fluid form, via conducting means 5. Such supply is illustrated by arrow F4. In the device of FIG. 1, the injection device 3 transforms the plasma jet 2 of uniform section into a jet 6 (arrow F6) having the shape of a cylindrical envelope coaxial to axis X—X, i.e. the section of the plasma jet 2 downstream of the injection device 3 presents an annular section. Moreover, the injection device 3 emits a jet 7 (arrows F7) of fluid matter 4, inside said plasma envelope 6 and coaxially thereto. Downstream of the injection device 3, for example at a distance L therefrom equal to several times the diameter D of the plasma jet 2, homogeneous jet 8 is obtained (arrow F8) resulting from the combination, the interaction and/or the reaction of the plasma jet 2 and of the fluid matter 4, thanks to the intimate mixture of the plasma envelope 6 and of the coaxial jet 7.

The embodiment schematically illustrated in FIG. 2 also comprises the plasma generator 1, the plasma jet 2, the injection device 3, the means 5 for conducting the fluid matter 4 and the jet 7 of the latter. In that case, the plasma envelope 9 (arrow F9), which is formed by the injection device 3 and coaxially to which the jet 7 is injected, is no longer cylindrical like the envelope 6 of FIG. 1, but conical and convergent towards axis X—X. The mixture of the plasma envelope 9 and of the jet 7 of fluid matter creates, downstream of the device 3 and at some distance therefrom, a homogeneous jet 10 of plasma and of matter 4.

In the embodiments of FIGS. 1 and 2, the jet 7 of fluid matter 4 (arrow F7) is directed in the same direction as the plasma jets 2, 6 and 9, i.e. towards the resultant homogeneous jets 8 and 10 and therefore towards downstream. On the other hand, in the embodiment of FIG. 3, the jet 11 of fluid matter 4 (arrow F 11) is directed in the opposite direction to plasma jet 2, i.e. in counter-flow towards upstream of said plasma jet 2. In that case, the matter 4 coming from jet 11 passes through the injection device 3 and is transported towards downstream by the plasma envelope 6 (or 9).

Of course, although this has not been shown in the Figures, in a device according to the invention, a jet 7 of fluid matter directed towards downstream and a jet 11 of fluid matter directed towards upstream may be provided. In that case, the matters of jets 7 and 11 may be different.

Figure 5:
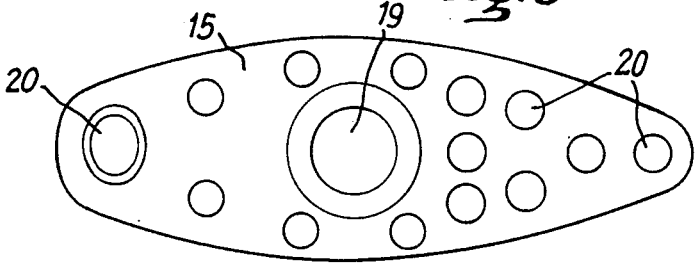
FIG. 5 is a section along line V—V of FIG. 4.
Figure 4:
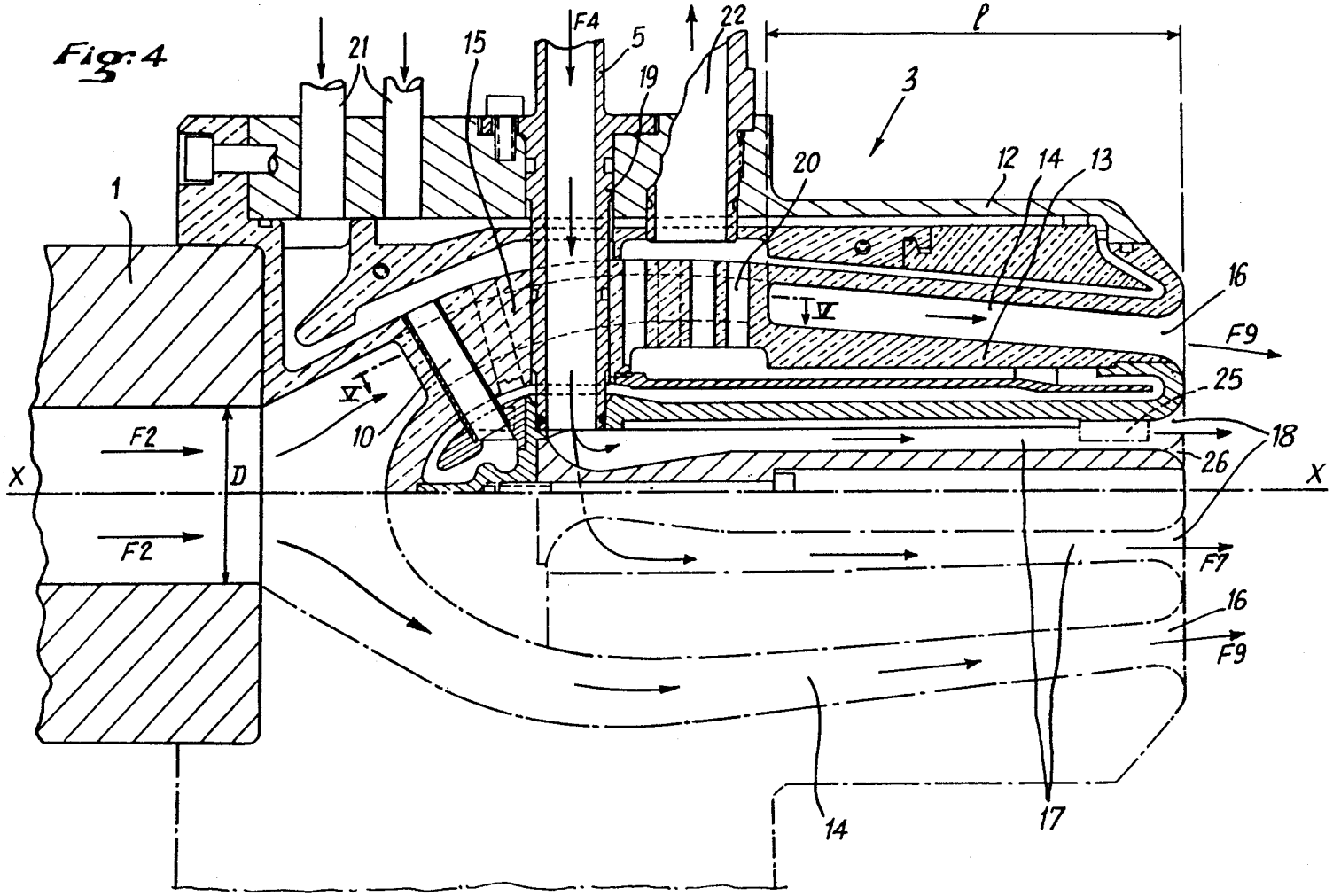
FIG. 4 shows, in axial section, an embodiment of the device according to the present invention, the lower half of this section, in dashed and dotted lines, being merely schematic.

FIGS. 4 and 5 show an embodiment of the injection device 3. This comprises a peripheral body 12 and a central body 13, defining therebetween a channel 14 of revolution, said central body 13 being fast with the peripheral body 12 via at least one arm 15 partially obturating the channel of revolution 14.

The peripheral body 12 is fixed to the outlet of the plasma generator 1 and the central body 13 and the arm 15 are sectioned aerodynamically. The plasma jet 2 emerging from the generator 1 (arrows F2) penetrates into the coaxial device 3 and is shaped as a conical envelope by passage in the annular channel 14, going around the central body 13 which forms obstacle and which is for example in the form of a bulb. The jet 9 in the form of a conical envelope (arrows F9) emerges from the device 1 via the annular nozzle 16. The central body 13 comprises a central annular passage 17 terminating in an annular nozzle 18, coaxial to the annular nozzle 16, but smaller than it. Via a conduit 19, passing through the arm 16, the downstream annular passage 17 and the nozzle 18 are supplied with fluid matter 4 from the supply means 5.

Furthermore, circuits for the circulation of cooling fluid are provided in said peripheral and downstream bodies 12 and 13. These circuits are in connection with one another via conduits 20 passing through the arm 15 and are connected with the outside via admission pipes 21 and a return pipe 22.

Figure 6:
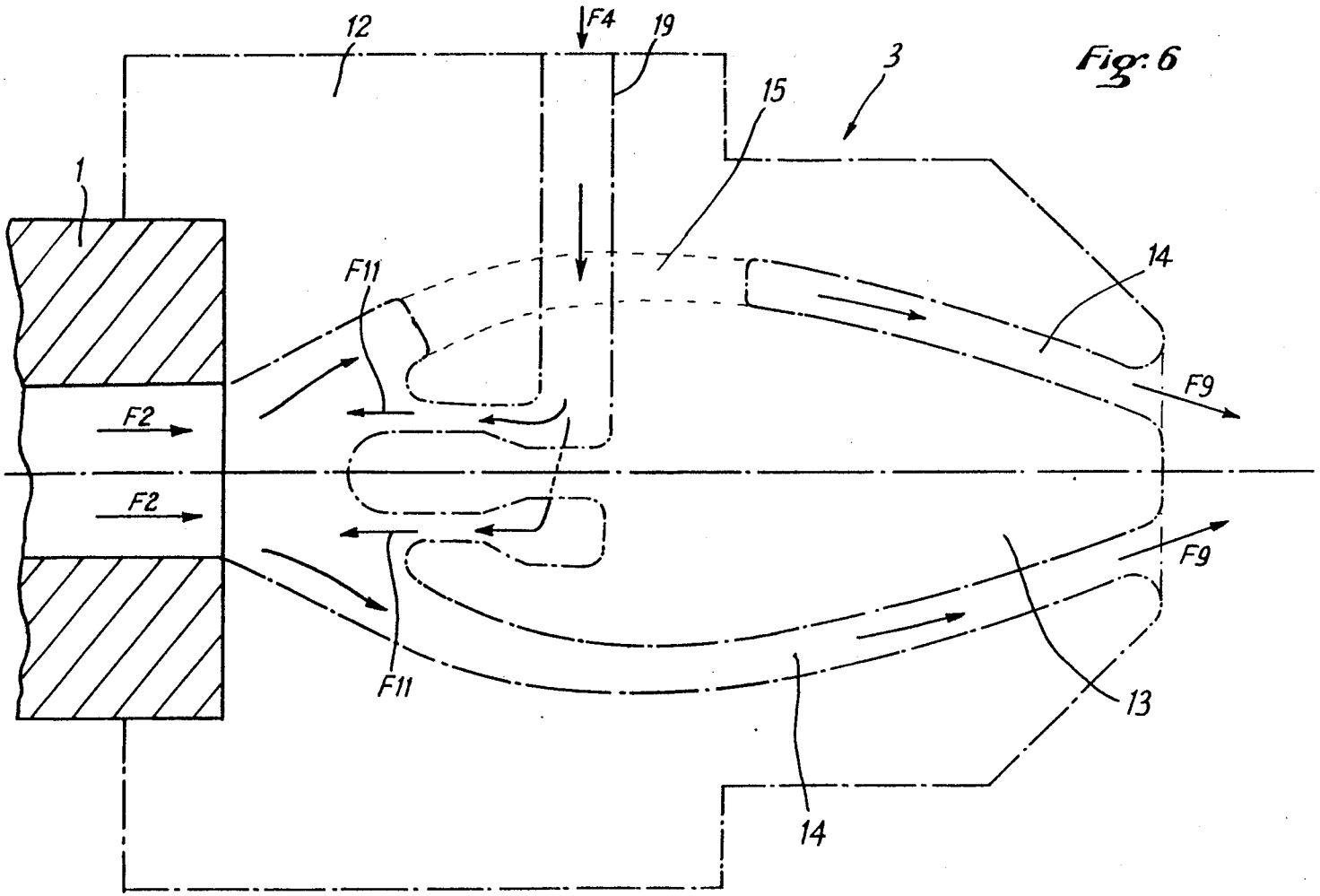
FIGS. 6 and 7 show two variants of the device of FIG. 4.

The device 3 of FIGS. 4 and 5 corresponds to that of FIG. 2 in which the nozzle 18 emitting the jet 7 is directed towards downstream of the plasma jet. On the other hand, FIG. 6 schematically shows a device 3 adapted to the embodiment of FIG. 3, in which the jet 11 of fluid matter (arrows F 11) is directed towards upstream of the plasma.

Figure 7:
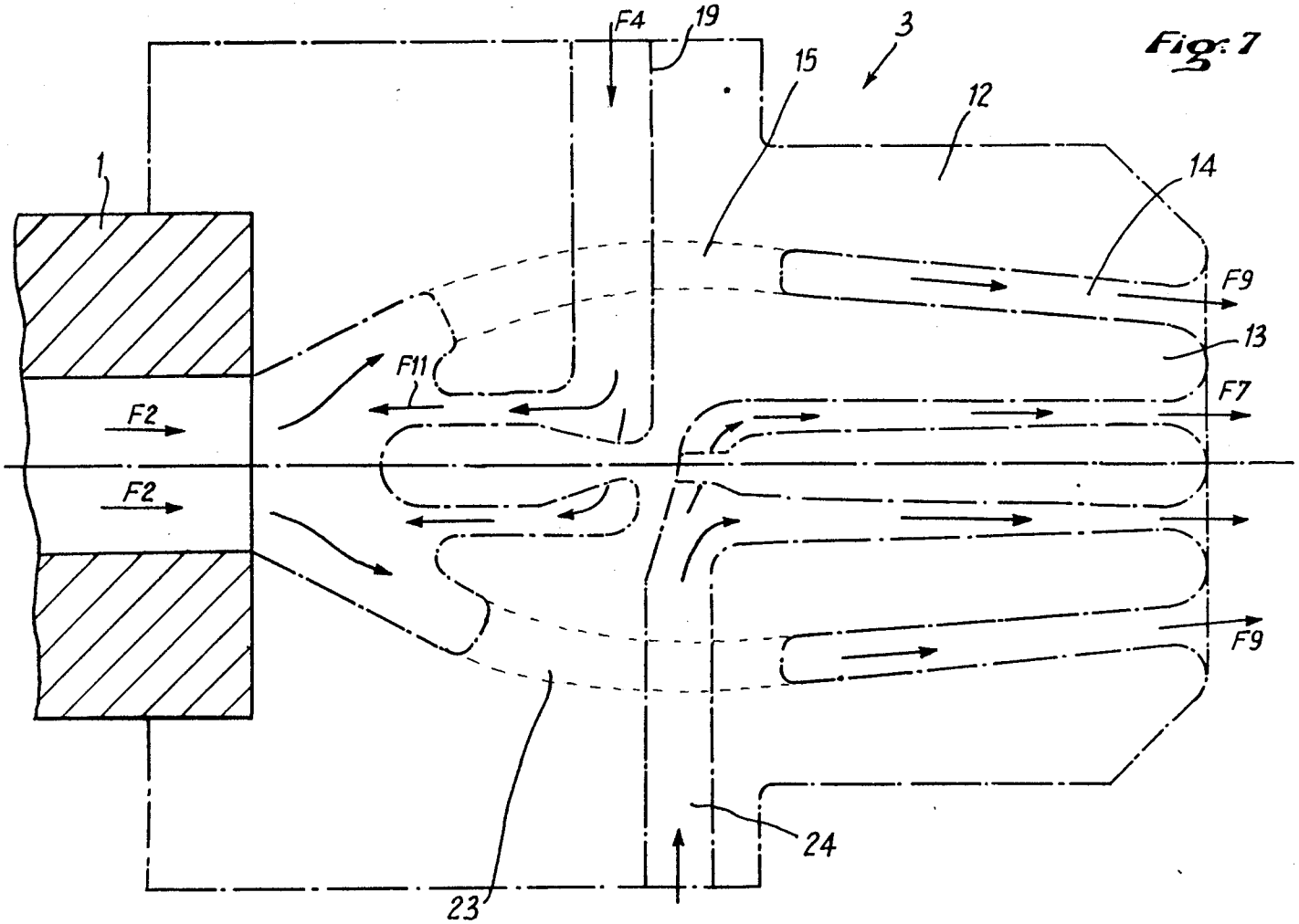

FIG. 7 schematically shows a device 3 for injecting a stream 7 (arrows F7) of fluid matter towards downstream and a stream 11 (arrow F11) of fluid matter towards upstream. It is assumed that the central body 13 was connected to the peripheral body 12 by two arms 15 and 23 and that the two streams 7 and 11 came from two different sources, through passages 19 and 24, traversing arms 15 and 23 respectively.

As may be seen in FIG. 4, vanes 25 or spoilers 26 may be provided in the channel 17, in the vicinity of nozzle 18, to create turbulences in the jet 7 of fluid matter, intended to facilitate even more the mixture of the particles of said jet with the plasma in envelope form.

Moreover, for the purpose of rendering perfectly homogeneous the gaseous flow to which fluid matter is added, the length 1 of the channel of revolution 14 downstream of the arm 15 is at least equal to once the diameter D of the jet 2.

What is claimed is:

1. A device for injecting at least one stream of a pulverulent material into a plasma stream comprising:

(a) a substantially annular-shaped first body having means defining an axial passage for a plasma stream, said body having an axial inlet and an axial outlet for said plasma stream;

(b) a central body disposed coaxially to said first body in said plasma stream, said central body further being spaced from said first body to define an annular channel whereby a plasma stream passing through the annular channel is shaped into an annular envelope;

(c) a nozzle disposed coaxially in said central body to inject a fluid stream of at least one pulverulent material coaxially into said annular envelope, wherein said pulverulent material is substantially contained in said annular envelope as the plasma stream and fluid stream exit the annular channel for a predetermined distance and subsequently forms a homogeneous stream of plasma and pulverulent material.

2. The device of claim 1 wherein the nozzle is disposed at a downstream end of the central body.

3. The device of claim 1 wherein said central body is supported by at least one arm extending from the first body.

4. The device of claim 1 wherein said fluid stream of pulverulent material is fed to said nozzle through a conduit extending through said arm.

5. The device of claim 1 wherein said nozzle defines an annular passage coaxially disposed in said central body whereby said fluid stream of pulverulent material exits the nozzle in an annular flow.

6. The device of claim 5 wherein said annular channel extends downstream from said support arm a distance substantially equal to the diameter of a plasma stream inlet in said first body.

7. The device of claim 1 wherein said nozzle includes a downstream end terminating at the end of the central body.

8. The device of claim 1 wherein said annular channel is substantially conical and converges toward a downstream end of said first body.

9. A process for injecting at least one fluid stream into a plasma stream comprising the steps of:

(a) forming a substantially annular plasma envelope from a plasma stream, wherein said plasma envelope is disposed coaxially with the plasma stream, and (b) injecting a fluid stream into said plasma stream coaxially to the annular envelope, whereby said fluid stream is substantially contained by the annular envelope of plasma for a predetermined distance and subsequently forming a homogeneous stream of plasmas and fluid.

10. The process of claim 9 wherein said fluid stream includes a pulverulent particulate.

11. The process of claim 9, wherein said envelope of plasma is at least substantially conical.

12. The process of claim 9, wherein the fluid stream has a substantially homogeneous circular section.

13. The process of claim 1, wherein the fluid stream has an annular cross-section.

* * * * *